United States Patent [19]

Zelina

[11] 4,181,928

[45] Jan. 1, 1980

[54] PORTABLE SPOT/FLOOD LIGHT

[75] Inventor: Thomas Zelina, Erie, Pa.

[73] Assignee: Lighting Systems, Inc., Erie, Pa.

[21] Appl. No.: 863,574

[22] Filed: Dec. 22, 1977

[51] Int. Cl.[2] ..... F21L 1/00; F21L 3/00; F21L 7/00; F21L 15/00

[52] U.S. Cl. ..... 362/184; D48/24 R; 362/196; 362/200; 362/222; 362/223; 362/224; 362/225; 362/236; 362/240; 362/241; 362/242; 362/243; 362/260; 362/263; 362/307; 362/310; 362/311; 362/374; 362/375

[58] Field of Search ..... 362/184, 196, 200, 201, 362/236, 240, 241, 185, 221, 222, 223, 224, 225, 242, 243; D48/24 R, 24 A

[56] References Cited

U.S. PATENT DOCUMENTS

| | | | |
|---|---|---|---|
| D. 233,251 | 10/1974 | Lowrance | D48/24 R |
| 1,626,901 | 5/1927 | Wish | 362/236 |
| 1,832,443 | 11/1931 | Barany | 362/184 |
| 2,454,670 | 11/1948 | Pollack | 362/223 |
| 2,597,705 | 5/1952 | Clines | 362/236 |
| 2,980,889 | 4/1961 | Meissner | 362/184 |
| 3,809,321 | 5/1974 | Rundberg | 362/184 |
| 3,947,678 | 3/1976 | Tang | 362/222 |
| 4,052,806 | 10/1977 | George | 362/224 |
| 4,074,122 | 2/1978 | Moore | 362/223 |

FOREIGN PATENT DOCUMENTS

| | | | |
|---|---|---|---|
| 189716 | 4/1957 | Austria | 362/224 |
| 1031424 | 6/1958 | Fed. Rep. of Germany | 362/223 |
| 360729 | 4/1962 | Switzerland | 362/184 |
| 703260 | 2/1954 | United Kingdom | 362/222 |
| 1151150 | 5/1969 | United Kingdom | 362/200 |

*Primary Examiner*—Benjamin R. Padgett
*Assistant Examiner*—T. S. Gron
*Attorney, Agent, or Firm*—Charles L. Lovercheck

[57] ABSTRACT

A portable light having a U-shaped body and an elongated reflector supported on the body providing a space for batteries between the reflector and the body. Two lamps are supported on the reflector providing a flood light and a lens is supported on the body over the reflector and the lamps. Two cup-shaped end caps are supported on the ends of the light and one end cap has a frusto-conical shaped reflector integrally attached to it, and a lens closes the end of the cap having the reflector in it, and a lamp is supported on the reflector under the lens providing a spot light.

6 Claims, 3 Drawing Figures

FIG. 1.
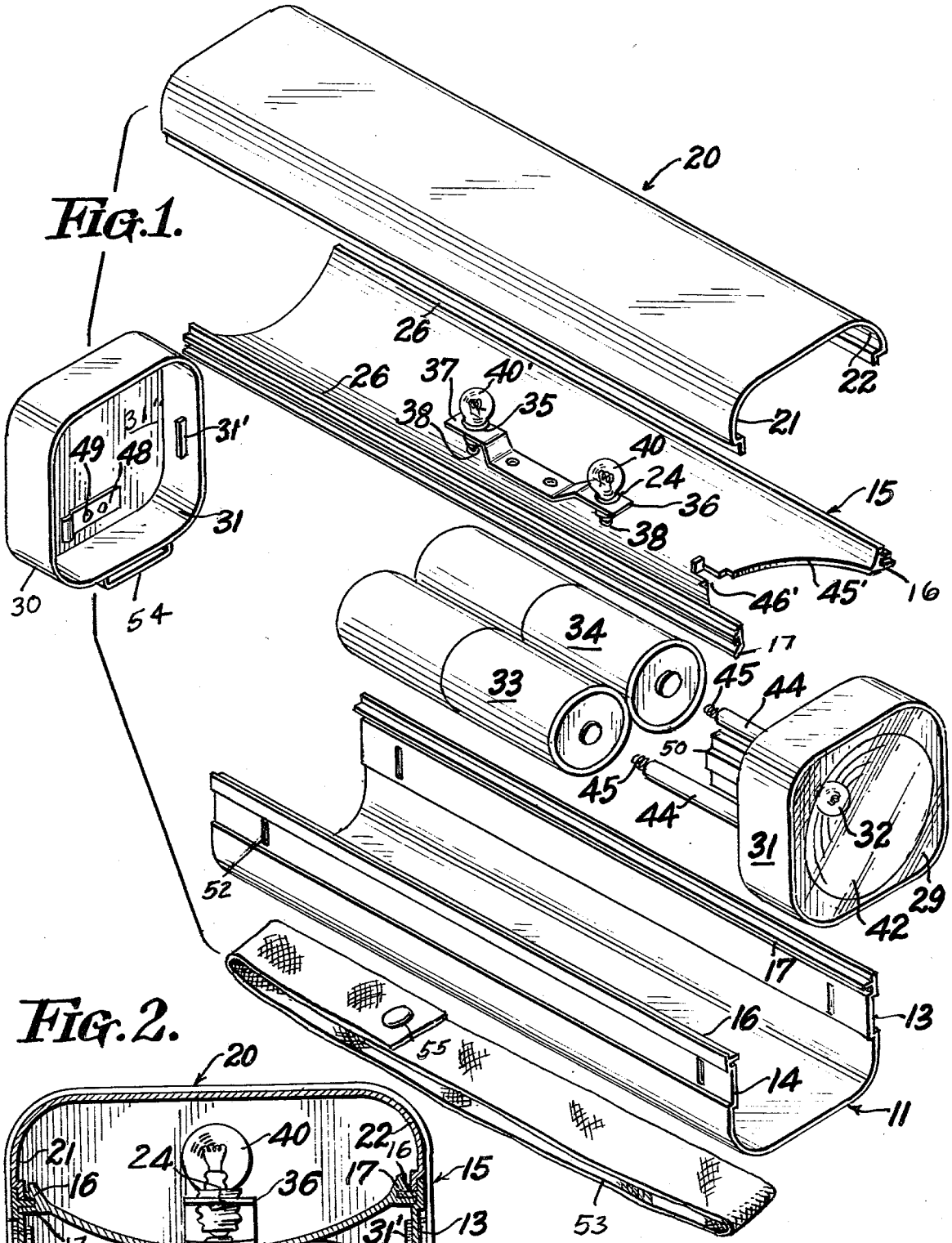
FIG. 2.
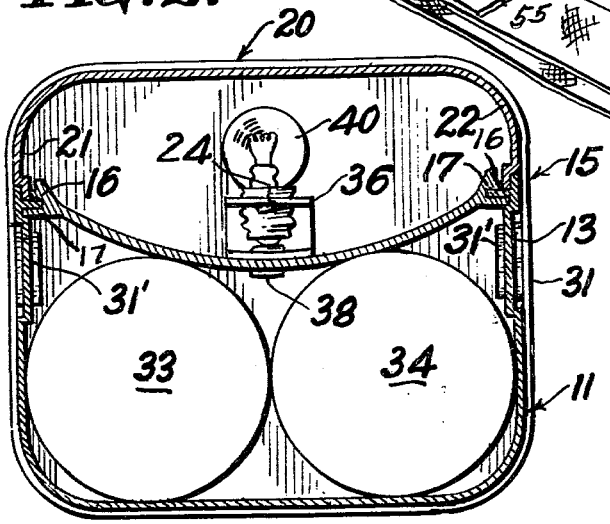
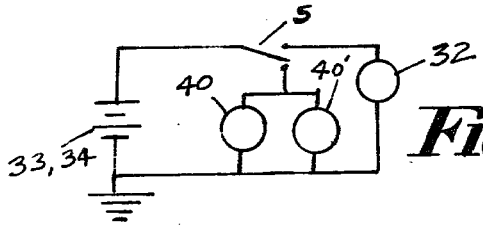
FIG. 3.

PORTABLE SPOT/FLOOD LIGHT

REFERENCE TO PRIOR ART

Prior lights of the general type disclosed herein are shown in U.S. Pat. Nos. 3,947,678; 3,809,321; and U.S. Pat. No. D233,251. None of these lights show the combination of parts disclosed herein.

OBJECTS OF THE INVENTION

It is an object of the invention to provide an improved combination flood light and spot light.

Another object of the invention is to provide a flood light having an elongated reflector supported on the side of the light in combination with a spot light having a reflector adapted to project light from the end of the light.

Another object of the invention is to provide a combination flood and spot light that is simple in construction, economical to manufacture and simple and efficient to use.

With the above and other objects in view, the present invention consists of the combination and arrangement of parts hereinafter more fully described, illustrated in the accompanying drawings and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

FIG. 1 is an exploded view of the floodlight according to the invention.

FIG. 2 is a longitudinal, cross-sectional view of the U-shaped body of the light.

FIG. 3 is a view of the electrical circuit according to the invention.

DETAILED DESCRIPTION OF THE DRAWINGS

The light shown at 10 is made up of a generally U-shaped body 11 and an elongated reflector 15, elongated lens 20 and two end caps 29 and 30. The reflector has a suitable reflecting surface on its front. The body 11 is generally U-shaped and has two upwardly extending legs 13 and 14 integrally connected together and adapted to receive the dry cell batteries 33 and 34 which are of a type familiar to those skilled in the art.

The elongated reflector 15 closes the upper end of the body 11 and has a U-shaped groove at each side which receives the beads 16 and 17 which are integrally connected to the body 11.

The bracket 36 is attached to the intermediate part of the reflector 15 and it has threaded openings 24 and 35 which receive the lamps 40 and 40' which extend downwardly and their terminal ends engage terminals 38 that extend through the reflector and are electrically connected to the terminals 45 on the posts 44.

The rigid posts 44 are integrally molded with the underside of the spot reflector 42 which is in turn integrally molded as a single part with the end cap 29 and the end cap 29 has a transparent lens over the outside of the lamp 32 enclosing it in a conventional manner. Reflector 42 has a suitable reflecting surface adjacent lamp 32. The lamp support 50 extends into the notch 46 in the elongated reflector 15 and the contoured edge 45' receives the underside of the reflector.

The end cap 30 has the rim 31 that extends perpendicular to its bottom 31'' and which overlies the outside of the ends of the body 11, reflector 15 and lens 20 holding them together and the lugs 31' on the rim 31 snap into the openings 51 in the end of the body and hold the cap in place.

Similar lugs to lugs 31 are formed on the rim of end cap 29 and they snap into notches 52 in the other end of the body and hold the light in assembled position.

The strap 53 passes through the loops 54 on the end caps for carrying purposes. The strap 53 is held together by the snap fasteners 55.

The elongated reflector 15 has the upwardly extending flanges 26 which extend upwardly above the beads 16 and 17 and the edges 21 and 22 of the lens rest on the beads 16 and 17 when the lamp is in assembled condition. When the elongated reflector 15 is assembled on the body 11, by snapping the notches 18 and 19 over the beads 16 and 17 on the body, with the batteries 33 and 34 in the body and the lens 20 is supported with edges 21 and 22 resting in the space between the rims and the reflector 15 and the entire assembly held together by the end caps 29 and 30 snapped over the ends of the assembly when the terminals 45 will engage the ends of the batteries 33 and 34 providing a circuit through a suitable switch 57 to the lamps 40 and 41'. In this condition, the light is held in rigid assembled relation for use. Then since the switch 57 is a two-way switch when it is in one position, the batteries 33 and 34 will be connected in series with the lamp 32 through the terminal 45 and when the switch is in the other position the batteries 33 and 34 will be connected in series with the lamps 40 and 40' which may themselves be connected in parallel.

The lug 48 is attached to the end cap 30 by means of a rivet 49 and this lug 48 connects the batteries 33 and 34 in series.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A combination flood light and spot light comprising, an elongated, generally U-shaped body having first and second ends and an elongated lens forming one side of said body, an elongated, concave reflector supported in said body between said lens and said body, first end cap means and second end cap means, said first end cap means supported on the first end of said body and said second end cap means supported on the second end of said body, a first lamp means supported on said concave reflector, a spot reflector supported on said second end cap means, and a second lamp means supported on said second end cap means, batteries in said body, and means selectively connecting said battery to said first lamp and to said second lamp.

2. The light recited in claim 1 wherein said first lamp means is supported on said concave reflector at a position approximately midway between said two end caps.

3. The combination recited in claim 1 wherein said first lamp means are spaced incandescent lamps.

4. The light recited in claim 1 wherein terminal means are supported on said reflector engaging said battery means, and circuit means connecting said battery terminal means to said lamps, switch means on said body for selectively connecting said battery to said first light and to said second light.

5. The combination recited in claim 1 wherein said end caps each have a generally flat end and a flange extending generally perpendicular to said end, said flanges receiving said ends of said body and said lens holding said body in said lens and said elongated reflector together.

6. The combination recited in claim 1 wherein said flanges on said end caps each have inwardly extending lugs thereon received in notches in said U-shaped body.

* * * * *